US005734400A

United States Patent [19]

Brunetti et al.

[11] Patent Number: 5,734,400

[45] Date of Patent: Mar. 31, 1998

[54] METHOD AND APPARATUS FOR REFILLING INK JET UNIT PRINTER CARTRIDGES

[76] Inventors: Bruce W. Brunetti, 401 March Blvd., Phillipsburg, N.J. 08865; Wolfgang Witz, 350 Royal Manor Rd., Easton, Pa. 18042; Walter Barry Wexler, 718 E. Chew St., Allentown, Pa. 18013

[21] Appl. No.: 550,905

[22] Filed: Oct. 31, 1995

[51] Int. Cl.[6] ..... B41J 2/175; B67D 3/00

[52] U.S. Cl. ..... 347/85; 222/482

[58] Field of Search ..... 141/18, 19, 329, 141/330, 383, 384, 386; 347/85–87; 222/482, 541.2, 83.5, 88, 501, 507

[56] References Cited

U.S. PATENT DOCUMENTS

| | | | |
|---|---|---|---|
| 4,375,864 | 3/1983 | Savage | 222/501 |
| 4,949,878 | 8/1990 | Jacobi | 222/482 |
| 4,967,207 | 10/1990 | Ruder . | |
| 5,056,691 | 10/1991 | Tolbert | 222/482 |
| 5,199,470 | 4/1993 | Goldman . | |
| 5,280,300 | 1/1994 | Fong et al. . | |
| 5,329,294 | 7/1994 | Ontawar et al. . | |
| 5,359,353 | 10/1994 | Hunt et al. . | |
| 5,400,573 | 3/1995 | Crystal et al. . | |
| 5,531,055 | 7/1996 | Sell et al. | 347/85 |
| 5,555,007 | 9/1996 | Ceschin et al. | 347/87 |

OTHER PUBLICATIONS

*Hewlett Packard Catalog* (1995), pp. 55–60.

*Primary Examiner*—Benjamin R. Fuller
*Assistant Examiner*—Judy Nguyen
*Attorney, Agent, or Firm*—David H. Semmes

[57] ABSTRACT

As applied to printer ink cartridges having a collapsible container therein, ink refilling is accomplished through the use of a clamp and filler cartridge assembly wherein a slideable cartridge sealing plug initiates and terminates the refill process, depressurizing the cartridge at refill completion, whereby upon removal of the filling apparatus, the ink jet unit automatically obtains negative pressure. Leakage is thus precluded. At an ink jet unit filling station, one first inserts a clamp/ink cartridge filler assembly upon the empty ink jet cartridge, displacing the conventional sealing ball of the pointer ink cartridge; second, the clamp/ink cartridge filling assembly is rotated relative to its clamp to dislodge the ink cartridge stopper; third, the filler cartridge assembly plug is removed, draining ink into the ink jet unit; fourth, the filler cartridge assembly plug is replaced; fifth, the ink jet unit is depressurized; and sixth, the clamp and filler cartridge assembly are removed from the ink jet unit to complete the refill method. Filling station apparatus includes a clamp with locking elements engaging a slideable and rotatable ink filler cartridge having coactive locking and ink sealing and dispensing passages. There is no modification to the existing ink jet unit printer cartridge, per se.

1 Claim, 3 Drawing Sheets

METHOD AND APPARATUS FOR REFILLING INK JET UNIT PRINTER CARTRIDGES

BACKGROUND OF THE INVENTION

The invention comprises method and apparatus in the form of a kit which is principally applicable but not limited to the refilling of printer ink cartridges of the type defined in U.S. Pat. No. 5,040,001 dated Aug. 13, 1991 and No. 5,359,353 dated Oct. 25, 1994. A fresh printer ink cartridge of the latter kind consists of a rigid external housing containing an inner sealed unit holding approximately 40 ml of ink with a nozzle array intended to eject ink drops during printing. To activate, the user removes a tape seal from the nozzle plate. There is no intentional air inside the unit and the ink inside the printer ink cartridge can only exit that cartridge from the nozzles, as is the case during printing in the printer or plotter. Although a fill hole is present in the cartridge, this hole is sealed with a ball by the manufacturer and no air can enter the cartridge. Characteristically there are more than 60 and as many as 200 nozzles, all of which however have such small diameters, typically less than 75 μ, such that relatively strong negative pressures inside the cartridge are needed to pull air into the cartridge through any of the nozzles. This does not occur during normal operation of the printer ink cartridge.

As ink is ejected from the nozzles during printing, two internal opposed springs hold side plates apart in the cartridge. These provide for a moderate negative pressure inside the unit which prevents the ink from coming out of the nozzles during the non-printing state of the unit. The springs collapse slowly to compensate for the decrease in ink volume. Color paper tabs connected to the outside of the inner flexible unit are made to move relative to one another by the motion of the side plates to indicate amount of ink remaining. The plates continue to approach each other as ink is used up during normal operation of the cartridge. There being no air in the prater ink cartridge, the cartridge is relatively insensitive to temperature and pressure changes, since the ink does not appreciably expand or contract. Even if some small quantity of air does get trapped in the cartridge, the springs compensate for any volumetric changes and keep the pressure in the ink at the nozzle level at a negative value, thereby preventing ink from drooling from the nozzle plate.

When the ink jet printer ink cartridge nears the end of its ink content, the opposing plates, kept separate by the spring arrangement, begin to touch and greater and greater negative pressures are created in the cartridge since no further reduction of volume is possible. The cartridge begins to eject smaller drops and eventually to fail to eject drops from some of the nozzles, since refill of the nozzle chambers begins to take more and more time. With further depletion of ink, nozzles fail at such a rate that print quality becomes totally unacceptable and the user is forced to replace the cartridge even if he had up till then, ignored the color tab low ink indicator. Typical pressures during the operating life of the cartridge range from −15 to −35 cm of water which is adequate to prevent ink from exiting the nozzles and not too negative to interfere with drop formation at the nozzle orifice.

This invention is directed to the most efficient refilling of such ink jet cartridges.

THE PRIOR ART

The known prior art includes the following:

| INVENTOR | DATE | PAT. NO. | TITLE |
|---|---|---|---|
| Ruder | 1990 | 4,967,207 | Ink jet Printer with Self-Regulating Refilling System |
| Goldman | 1993 | 5,199,470 | Method for Refilling Ink Cartridges |
| Fong et al. | 1994 | 5,280,300 | Method for Replenishing an Ink Cartridge |
| Ontawar et al. | 1994 | 5,329,294 | User Refillable Ink Jet Cartridge and Method |
| Hunt et al. | 1994 | 5,359,353 | Spring-Bag Printer Ink Cartridge |
| Crystal et al. | 1995 | 5,400,573 | Kit and Method for Opening, Refilling and Sealing a Cartridge |

The problem with maintaining negative pressure in the refilling of printer ink cartridges, having collapsible reservoirs, is recognized in U.S. Pat. No. 4,967,207 and No. 5,280,300, set forth above. Within this invention, a nozzle stopper stem over a fill hole of the ink jet cartridge, dislodges its existing sealing ball and separates it during the extraction of ink to effectively reseal the ink jet unit after the refill process. Interferences are chosen such that the stopper stays on the refilling stem until the operator removes the principal refill clamp from the ink jet unit. The filling station cartridge itself is provided with a moveable sliding cartridge sealing plug that in the two preferred locations initiates and terminates the refill process. The sealing plug serves to assist in depressurizing the refilled printer ink cartridge when it is moved to its sealing position. Unlike prior art, activation of the ink reservoir for the refill kit is achieved by rotating one filler unit part relative to another. A sliding, rotating relative part motion is used to depressurize the ink jet unit, to automatically obtain the required negative pressure for ink jet unit stability, upon removal of the filling station apparatus from the ink jet unit, per se. The stopper automatically seals the fill hole to maintain the negative pressure.

SUMMARY OF THE INVENTION

There are two types of cartridge herein. With respect to the ink jet unit, there is its printer ink cartridge which contains a collapsible inner sealed unit. With respect to the invention there is the filling station cartridge, per se.

As applied to Type 640 HP Printer Ink Cartridges and the like, ink refilling is accomplished through the use of a slideable cartridge sealing plug which initiates and terminates the refill process. Depressurizing the printer ink cartridge is achieved by rotation of cartridge relative to the adapter whereby the ink jet unit automatically obtains negative pressure. At an ink jet unit filling station, one first inserts a clamp/ink cartridge assembly, displacing the sealing ball of the printer ink cartridge. Second, the ink cartridge is rotated relative to its clamp to dislodge the stopper of the ink cartridge; third, the filler cartridge assembly plug is removed, sucking ink into the ink jet unit; fourth, the filler cartridge assembly plug is replaced; fifth, the ink jet unit is depressurized; and sixth, the clamp/ink cartridge assembly, the filling station, is removed from the ink jet unit, sealing it and preparing it for another later refill.

DESCRIPTION OF PREFERRED EMBODIMENTS

Figure 1A:
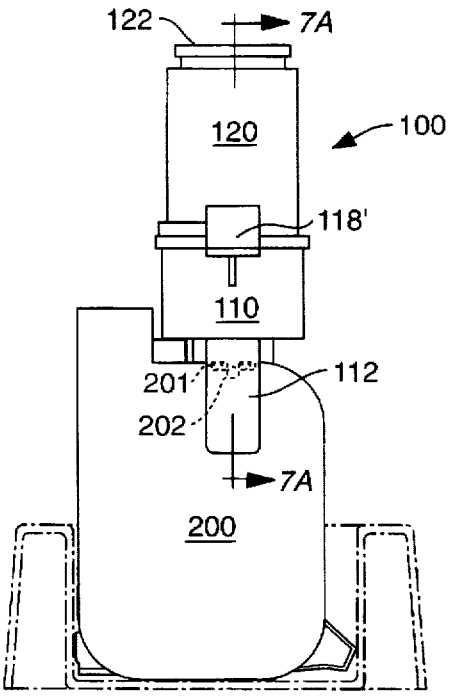
FIG. 1A is a schematic view in side elevation of an ink refilling station attached to a conventional ink jet unit with reservoir.

Apparatus as Applied to Ink Jet Unit

Referring to FIGS. 1A–B, 2A–B, 3, 4, 5A–B, 6A–B, 7A–B of drawings, ink refill cartridge and clamp assembly 100 for ink jet unit 200 includes, inter alia, clamp 110 and the filler cartridge 120 with its stopper 121 and cartridge assembly plug 122. See FIGS. 2A and 2B. The clamp 110 defines guidance tabs 112, between which is retained nozzle stopper stem 113, the latter stem defining transverse capillary passage 114. See FIG. 7A and 7B. A stopper 117 is displaceably set upon the stopper stem extension 116. Stem 113 and its extension 116, being terminated by this stopper 117, have an essential function during removal of the clamp 110 from ink jet reservoir cartridge 200. See FIGS. 6A and 6B. Associated with ink jet reservoir cartridge 200 is fill hole 201 and sealing ball 202. Conventional decompression springs of the ink jet unit are not shown, nor is the conventional collapsible reservoir of the ink jet unit. As indicated, U.S. Pat. No. 5,280,300 clearly illustrates such conventional structure. Retention of stopper 117 in ink jet fill hole 201 depends upon the depth of the hole and its containment of the stopper's vertical extension. See FIGS. 6B.

Figure 1B:
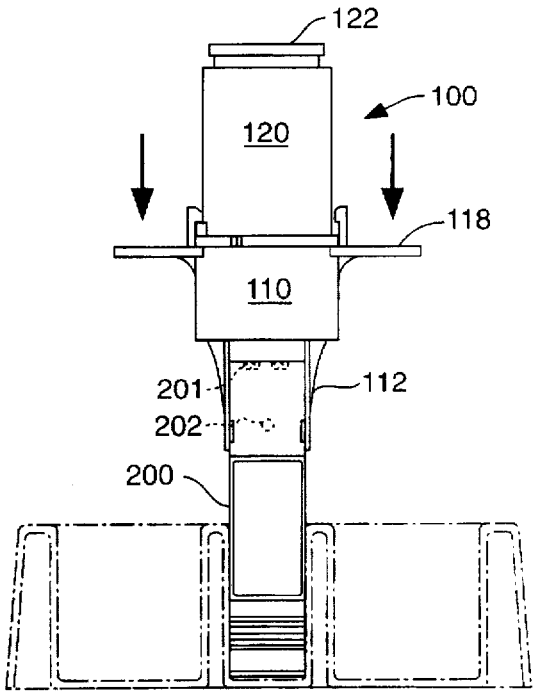
FIG. 1B is a frontal elevation view thereof.
Figure 3:
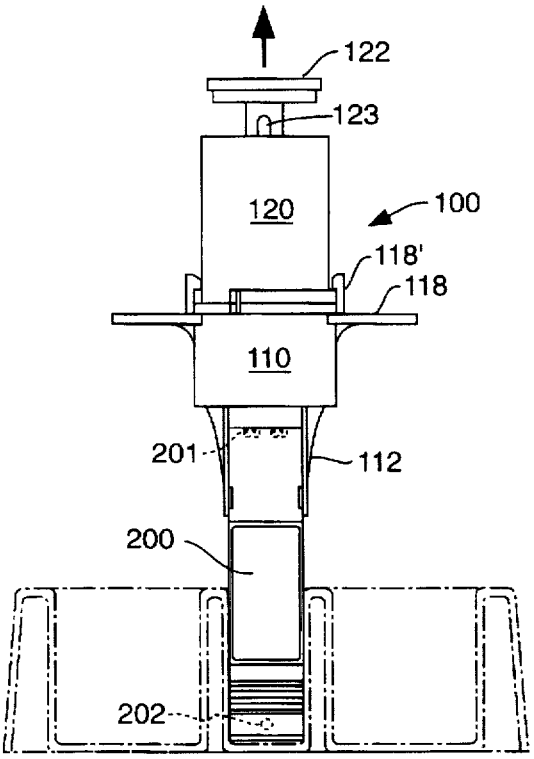
FIG. 3 illustrates, in schematic detail the third phase relationship between the filling station assembly of the invention and a conventional ink jet unit with reservoir wherein ink is sucked into the ink jet unit and its reservoir by virtue of lifting displacement of the filling station plug.

As illustrated in FIGS. 1A and 1B, biased retainers 118' on an upper ring 118 of clamp 110 are adapted to interlock with a corresponding rim of the filler cartridge 120. The retainers 118' comprise vertical protrusions of wing extensions 118. See FIG. 7A. Filler cartridge assembly plug 122 is to be temporarily dislodged as seen in FIG. 3. The plug 122 having been pulled upwardly, its ink passage slot 123 is exposed to the atmosphere, resulting in drainage of ink from the filling station 100 into the overall ink jet reservoir assembly 200. As will appear in FIG. 5B, there are coactively disposed two ramps. Ramp 115 is the mating ramp of clamp 110 and the related element is ramp 124 of the filler cartridge 120, effecting depressurization.

Method of Refilling Ink Jet Unit Reservoir

Having defined the invention with respect to the elements thereof, there follows a sequence in the filling operation. The clamp 110 and its slideably retained filler cartridge 120 are initially held in a deactivated relation by a suitable ink jet unit tray holder. See FIGS. 1A and 1B.

First, to commence preparation of the reservoir of the ink jet unit for refill, mount the filling station 100 on the airtight ink jet cartridge 200 by grasping the entire filling station unit and firmly pressing it down onto the cartridge 200. See FIG. 1B. Tabs 112 of the clamp 110 provide guidance onto the ink jet unit, accurately guiding the clamp 110, per se, so that its nozzle stopper stem 113 is in correct position to enter the ink jet unit 200 via fill hole 201 and to simultaneously displace sealing ball 202 located therein. See FIGS. 1A and 7A. This action is achieved in a single firm stroke. See FIG. 1B.

Figure 2A:
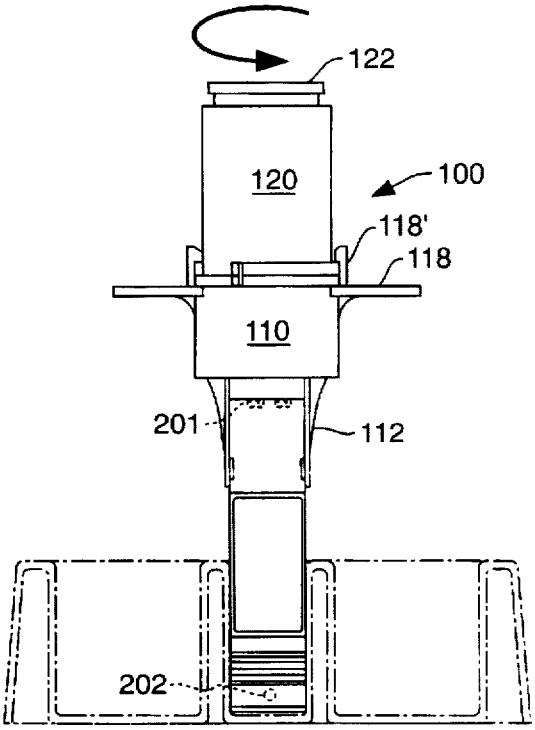
FIG. 2A is a schematic view in front elevation of the attached ink refilling apparatus assembly of FIG. 1B detail the second phase whereby an internal stopper of an ink refill cartridge is being dislodged by rotating the ink refill cartridge.
Figure 2B:
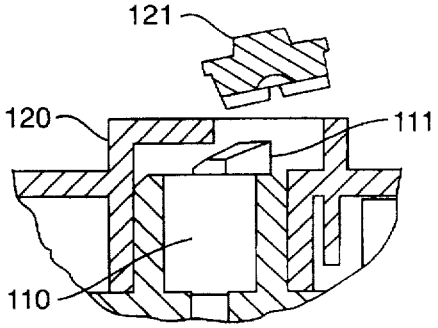
FIG. 2B is an enlarged vertical section of an interior portion of FIG. 2A.

Second, to start the refill process, rotate the filler cartridge 120 one-third of a turn 120° relative to the clamp 110, from an initial indent to a successive indent. Reverse rotation is prohibited by nonsymmetric shape of the indent of the conventional ink jet cartridge and of a mating protrusion of the clamp. As illustrated in FIG. 2A–2B, this initial rotational action dislodges internal stopper 121 of filler cartridge 120, since it is pushed up by an appropriately located ramp 111, located inside the bottom of the clamp 110. See FIG. 2B. The negative pressure of the reservoir of ink jet 200, with its conventional, collapsed internal springs, now pulls on the ink contained inside the filler cartridge 120 which, however at this point, cannot enter the reservoir of the ink jet 200 because the ink filler cartridge unit 120 remains airtight.

Third, to enable ink to be sucked into the reservoir of the ink jet unit 200, pull the filler cartridge plug 122 up and away from filler cartridge 120, to its maximum extended position, as illustrated in FIG. 3; thus air is allowed to enter the ink cartridge 200 through slot 123 on the stem of the plug 122. Air entering the filler cartridge 120, in turn, allows ink to be sucked through the hole 114 of the stopper stem 113, into the collapsed ink jet cartridge 200 and filling it. As the reservoir of the ink jet cartridge 200 fills, its internal springs gradually expand the internal volume of the conventional flexible reservoir container within cartridge 200. Enough ink (±43 ml) is provided within cartridge 120 to fill the reservoir of the ink jet cartridge 200 to capacity. The positioning of critical elements, which permits sucking of ink from filler cartridge 120 to ink jet unit 200, is depicted in FIG. 3.

Figure 4:
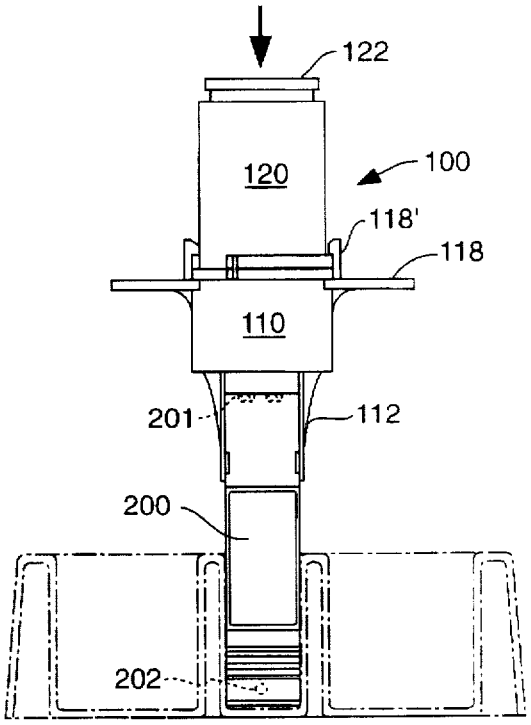
FIG. 4 illustrates in schematic detail the fourth phase relationship between ink refill cartridge assembly and conventional ink jet unit with reservoir, wherein the filler plug is downwardly replaced, relative to the ink jet cartridge unit.
Figure 5A:
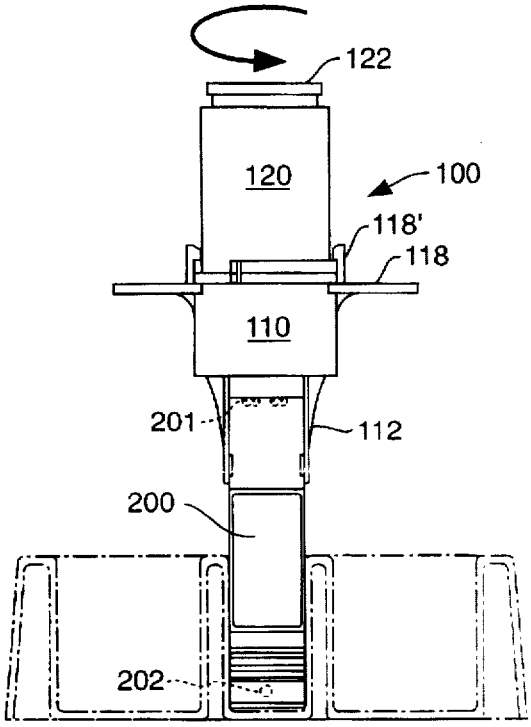
FIG. 5A illustrates in schematic detail the fifth phase in the disposition of elements of filling station relative to each other, for back pressurization of the ink jet unit reservoir.
Figure 5B:
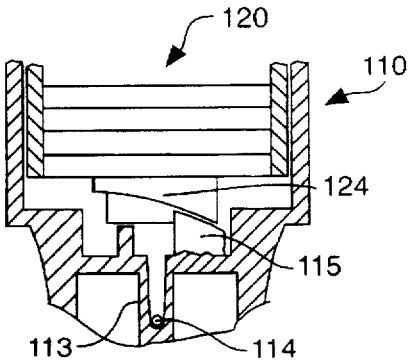
FIG. 5B is an enlarged vertical section of an interior portion of FIG. 5A.

Fourth, after a predetermined time, or until ink exits the existing nozzle (not shown) of the ink jet unit 200, the ink filler cartridge plug 122 is now pushed down, back to its sealing position, as illustrated in FIG. 4, slowing the flow of any additional ink. Air which is now captive in the filler cartridge 120, will decrease in pressure as more ink is removed, balancing the negative pressure of conventional internal container springs within the reservoir of the ink jet unit. Excess ink is carefully wiped from the nozzle face of the ink jet unit. This stops the filling process. See FIG. 4.

Fifth, to establish back pressure in the reservoir of the ink jet cartridge 200, one again rotates ink filler cartridge 120 to 170° clockwise relative to the clamp 110, to a successive click stop (not shown), which pushes the filler cartridge 120 out of the clamp 110 by an amount afforded by the height of the ramp 124 of the filler cartridge 120. See the engaging of refill cartridge ramp 124 by the mating ramp 115 of the clamp 110. This engagement results in an increase in internal volume of filler cartridge 120 and clamp 110. Since the volume of the captive ink and air is increased by this predetermined amount, the pressure in the reservoir of the ink cartridge 200 will collapse the conventional internal springs thereof a certain amount, thereby establishing the proper back pressure in the ink jet cartridge 200, to prevent leakage. See FIGS. 5A–B.

Figure 6A:
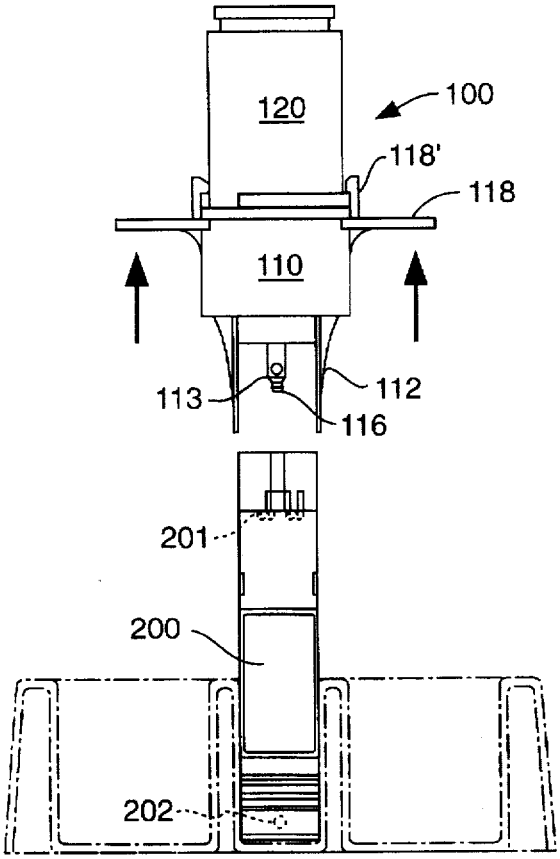
FIG. 6A illustrates, in schematic detail, the sixth phase in the removal of ink refill cartridge and clamp assembly from the ink jet unit with reservoir.
Figure 6B:
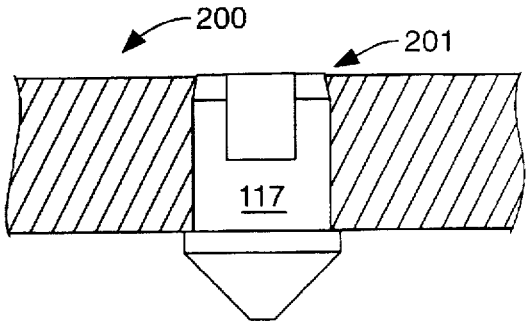
FIG. 6B is an enlarged vertical section of an interior portion of the ink jet unit of FIG. 6A.
Figure 7B:
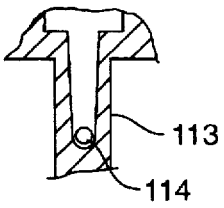
FIG. 7B is an enlarged vertical section of a portion of FIG. 7A.
Figure 7A:
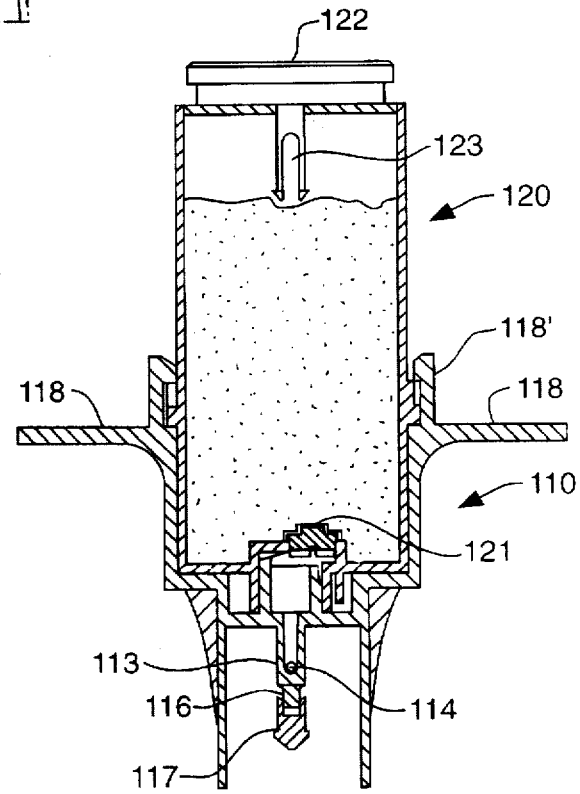
FIG. 7A is a vertical section view of the filling station assembly, less the ink jet unit of FIGS. 1A, 2A, 3, 4 and 5A inclusive of the drawings, taken along the lines 7A—7A of FIG. 1A.

Sixth, to firmly seal the ink jet cartridge 200, in one firm stroke, pull up the ink refill cartridge and clamp assembly 100 by wing extensions 118 protruding from the clamp 110, thus firmly removing the cartridge/clamp assembly 100. See FIG. 6A. This motion preserves the negative pressure of the ink jet reservoir 200 and the slightly collapsed state of its springs therein, since the stem 113 and its extension 116 interfere slightly with the hole 201 in the ink jet unit. As the stopper stem 113 is thus extracted from the fill hole 201, of the ink jet reservoir 200, the interference fit between stem extension 116 and stopper 117 which was adequate to hold the stopper 117 on the stem 113 during transit and insertion, is inadequate to pull the stopper 117 through the hole and fails. As illustrated in FIG. 6B, this leaves stopper 117 firmly lodged in the ink jet unit fill hole 201, FIG. 6A sealing it and allowing the clamp and cartridge assembly 100 to be removed from the ink jet unit, thereafter to be discarded. The ink filler stopper 117 firmly in place in the refilled ink jet cartridge 200, is designed to stay in place until the ink jet reservoir again runs out of ink and requires refilling. See both FIGS. 6A and 6B.

We claim:

1. An ink refill apparatus for refilling ink to a reservoir of an ink jet printer, comprising:

an ink refill cartridge having, at a lower end, an internal stopper and at an upper end, a reciprocable plug provided with a plug shaft slidably received in said upper end and having an air passage therein for defining an air vent passage; and a clamp receiving said lower end of said ink refill cartridge, said clamp including guidance tabs at a lower end of said clamp for guiding said clamp into said reservoir, a centrally disposed stem provided with a capillary passage for communicating with the ink refill cartridge and a removable stopper at a distal end of the stem, and a centrally disposed portion above said stem and adjacent to said internal stopper of said ink refill cartridge, said centrally disposed portion of said clamp having a ramp arranged relative to said internal stopper in a manner such that when the ink refill cartridge is rotated relative to the clamp, the internal stopper is rotated relative to the ramp such that the ramp forces the internal stopper into the ink refill cartridge so as to establish an ink flow path from the ink refill cartridge through said capillary passage and to said reservoir of said ink jet printer.

* * * * *